US010364121B2

(12) United States Patent
Doi

(10) Patent No.: US 10,364,121 B2
(45) Date of Patent: Jul. 30, 2019

(54) SHEET CUTTING APPARATUS

(71) Applicant: CANON KABUSHIKI KAISHA, Tokyo (JP)

(72) Inventor: Shigeo Doi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 50 days.

(21) Appl. No.: 15/592,742

(22) Filed: May 11, 2017

(65) Prior Publication Data

US 2017/0341898 A1 Nov. 30, 2017

(30) Foreign Application Priority Data

May 31, 2016 (JP) ..... 2016-109273

(51) Int. Cl.

| | |
|---|---|
| ***B26D 7/18*** | (2006.01) |
| ***B65H 35/06*** | (2006.01) |
| ***B26D 1/04*** | (2006.01) |
| ***G03G 15/00*** | (2006.01) |
| *B42C 1/12* | (2006.01) |

(52) U.S. Cl.

CPC ..... *B65H 35/06* (2013.01); *B26D 1/045* (2013.01); *B26D 7/1854* (2013.01); *G03G 15/00* (2013.01); *G03G 15/6582* (2013.01); *B42C 1/12* (2013.01); *B65H 2301/4229* (2013.01); *B65H 2301/5151* (2013.01); *B65H 2701/18271* (2013.01); *B65H 2701/18292* (2013.01); *B65H 2801/27* (2013.01); *G03G 2215/00814* (2013.01)

(58) Field of Classification Search

CPC ..... B26D 7/1845; B26D 7/1854; B26D 2007/0018; Y10T 83/2074; Y10T 83/222

See application file for complete search history.

(56) References Cited

U.S. PATENT DOCUMENTS

| | | | | |
|---|---|---|---|---|
| 5,377,569 A | | 1/1995 | Richards | |
| 5,379,668 A | * | 1/1995 | Standing | B26D 7/1854 83/167 |
| 6,532,856 B2 | | 3/2003 | Kato | |
| 8,011,282 B2 | * | 9/2011 | Yoshimaru | B26D 7/1854 83/100 |

FOREIGN PATENT DOCUMENTS

| | | |
|---|---|---|
| JP | 2008-207958 A | 9/2008 |
| JP | 2009-126690 A | 6/2009 |

* cited by examiner

*Primary Examiner* — Jennifer E Simmons

(74) *Attorney, Agent, or Firm* — Canon U.S.A., Inc. IP Division

(57) ABSTRACT

A sheet cutting apparatus includes a cutting unit configured to cut a sheet, a blowing unit configured to send air toward the cutting unit, a container unit configured to contain scraps generated when the sheet is cut, a scrap path configured to allow the scraps travelling toward the container unit from the cutting unit to pass through, wherein the scrap path is formed of a member provided with openings for allowing the air sent by the blowing unit to pass through.

19 Claims, 13 Drawing Sheets

SHEET CUTTING APPARATUS

BACKGROUND

Field of Art

The present disclosure relates to a sheet cutting apparatus for cutting a sheet.

Description of the Related Art

A sheet cutting apparatus for cutting sheets on which images are formed includes a container unit for containing scraps generated when the sheets are cut. The scraps falling from a cutting unit for cutting the sheets are accumulated in the container unit (see Japanese Patent Application Laid-Open No. 2009-126690).

There arises the following problems when air is blown to a cutting blade in order to prevent the scraps from sticking to the cutting blade. The air sent toward the cutting blade flows into the container unit in which the fallen scraps are accumulated. When the air flows into the container unit, there is a risk that an accumulation state of the scraps in the container unit is worsened because of the influence of the air flowing into the container unit. For example, the scraps may be unevenly accumulated therein or scattered from the container unit because of the air.

SUMMARY

According to an aspect of an embodiment, a sheet cutting apparatus for cutting sheets on which images are formed includes a cutting unit configured to cut the sheets, a blowing unit configured to send air toward the cutting unit, a container unit configured to contain scraps generated when the cutting unit cuts the sheets, and a scrap path configured to allow the scraps travelling toward the container unit from the cutting unit to pass through, wherein openings for allowing the air sent by the blowing unit to pass through are provided on a member that defines the scrap path.

Further features of the present invention will become apparent from the following description of exemplary embodiments with reference to the attached drawings.

DESCRIPTION OF THE EMBODIMENTS

An apparatus according to an exemplary embodiment will be described below in detail with reference to the appended drawings. In addition, sizes, materials, and relative positions of components constituting the apparatus are not intended to limit the scope of the present invention unless such limitations are explicitly mentioned as limiting the scope.

Figure 1:
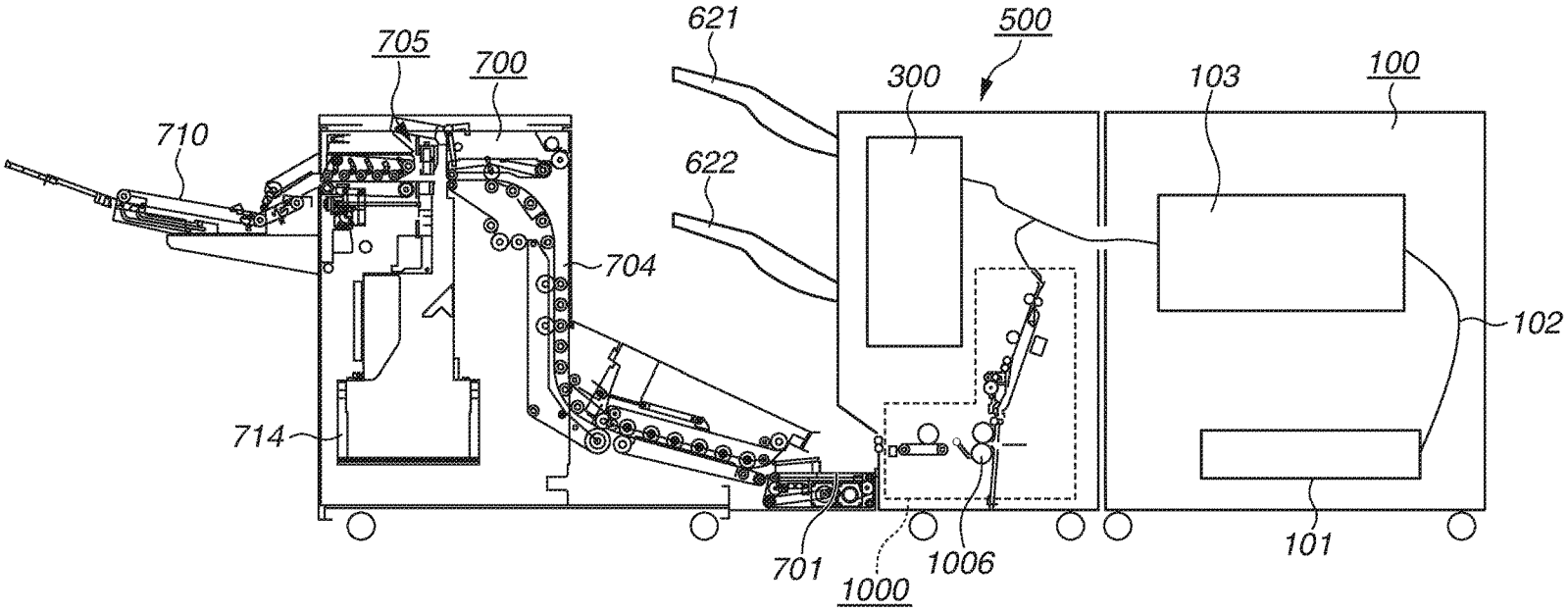
FIG. 1 is a cross-sectional diagram of an image forming apparatus.

FIG. 1 is a diagram illustrating an example of a configuration of an image forming apparatus according to an exemplary embodiment.

In FIG. 1, the image forming apparatus includes a printer main body (image forming apparatus main body) 100, a finisher 500, and a cutting apparatus 700 arranged on a downstream side of the finisher 500 in a sheet conveyance direction.

The printer main body 100 includes a sheet feeding cassette 101 for containing sheets and an image forming unit 103 for forming an image on a sheet conveyed from the sheet feeding cassette 101 via a sheet feeding path 102. A sheet on which an image has been formed by the image forming unit 103 is conveyed to the finisher 500. In the present exemplary embodiment, although description will be given of a configuration in which the printer main body 100 and the finisher 500 are provided as separate apparatuses, the finisher 500 and the printer main body 100 may be configured integrally.

The finisher 500 includes a side stitching processing unit 300 and a folding bookbinding processing unit 1000. The side stitching processing unit 300 executes processing of aligning and bundling the sheets conveyed from the printer main body 100 into a bundle and stapling processing for stapling a rear end of the bundled sheets with staples. The sheets processed by the side stitching processing unit 300 are discharged to a discharge tray 621 or 622.

Figure 3:
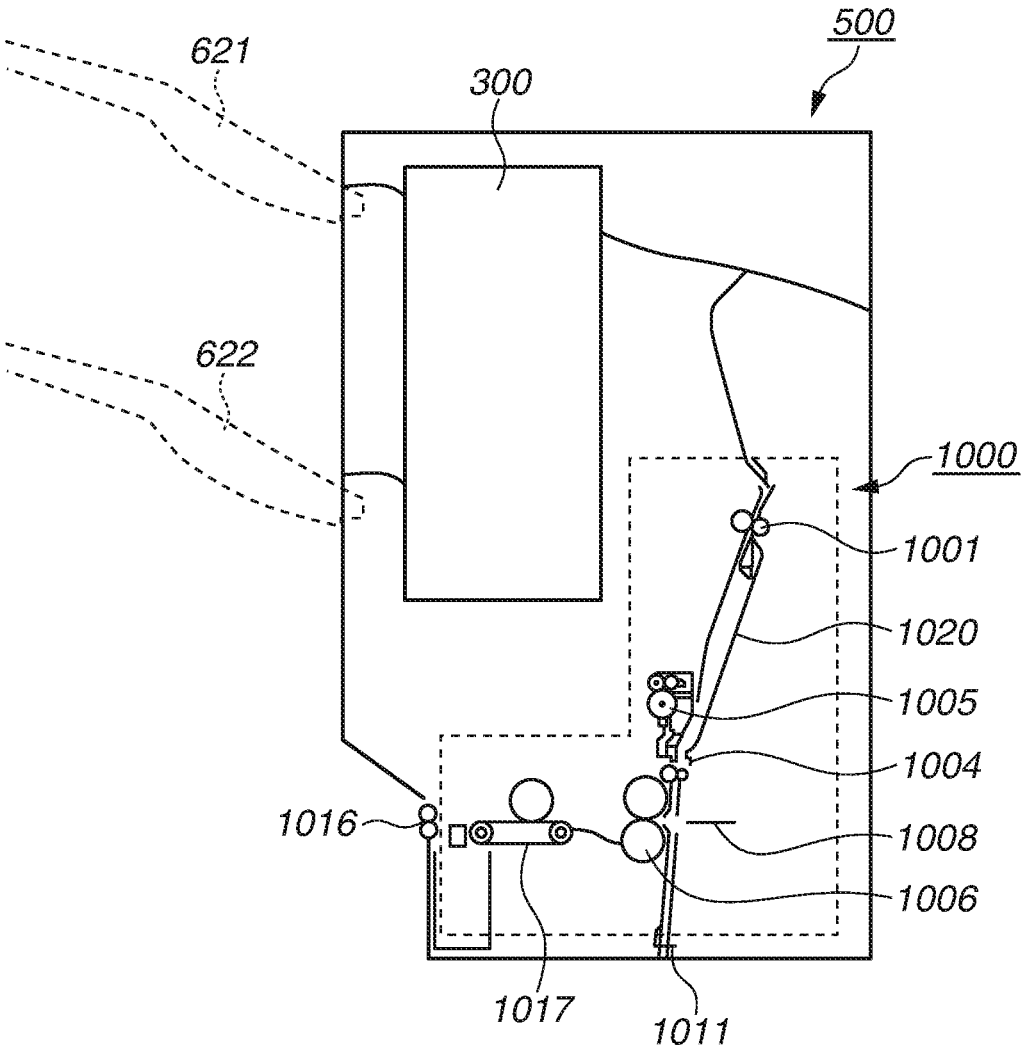
FIG. 3 is a cross-sectional diagram of a finisher.

As illustrated in FIG. 3, a containing guide 1020 for containing the sheet conveyed from the printer main body 100 is provided on the folding bookbinding processing unit 1000. The sheet conveyed to the containing guide 1020 is conveyed until a leading end of the sheet (a lower end of the sheet) is brought into contact with a movable sheet positioning member 1011.

Two pairs of staplers 1005 are arranged in an intermediate position of the containing guide 1020. An anvil 1004 is arranged at a position facing the staplers 1005. The staplers 1005 and the anvil 1004 cooperatively execute saddle stitching for binding a central portion of the sheet bundle.

A folding processing unit having a folding roller pair 1006 as a folding unit and a projection member 1008 arranged to face a nip portion of the folding roller pair 1006 is arranged at a downstream position of the staplers 1005. In addition, all of the saddle stitching processing and the folding processing are executed while leading end positions of the sheets are regulated by the sheet positioning member 1011.

A sheet bundle folded by the folding roller pair 1006 is conveyed to a conveyance belt 1017, and conveyed to the cutting apparatus 700 serving as a next post-processing apparatus by a discharge roller 1016.

Figure 4:
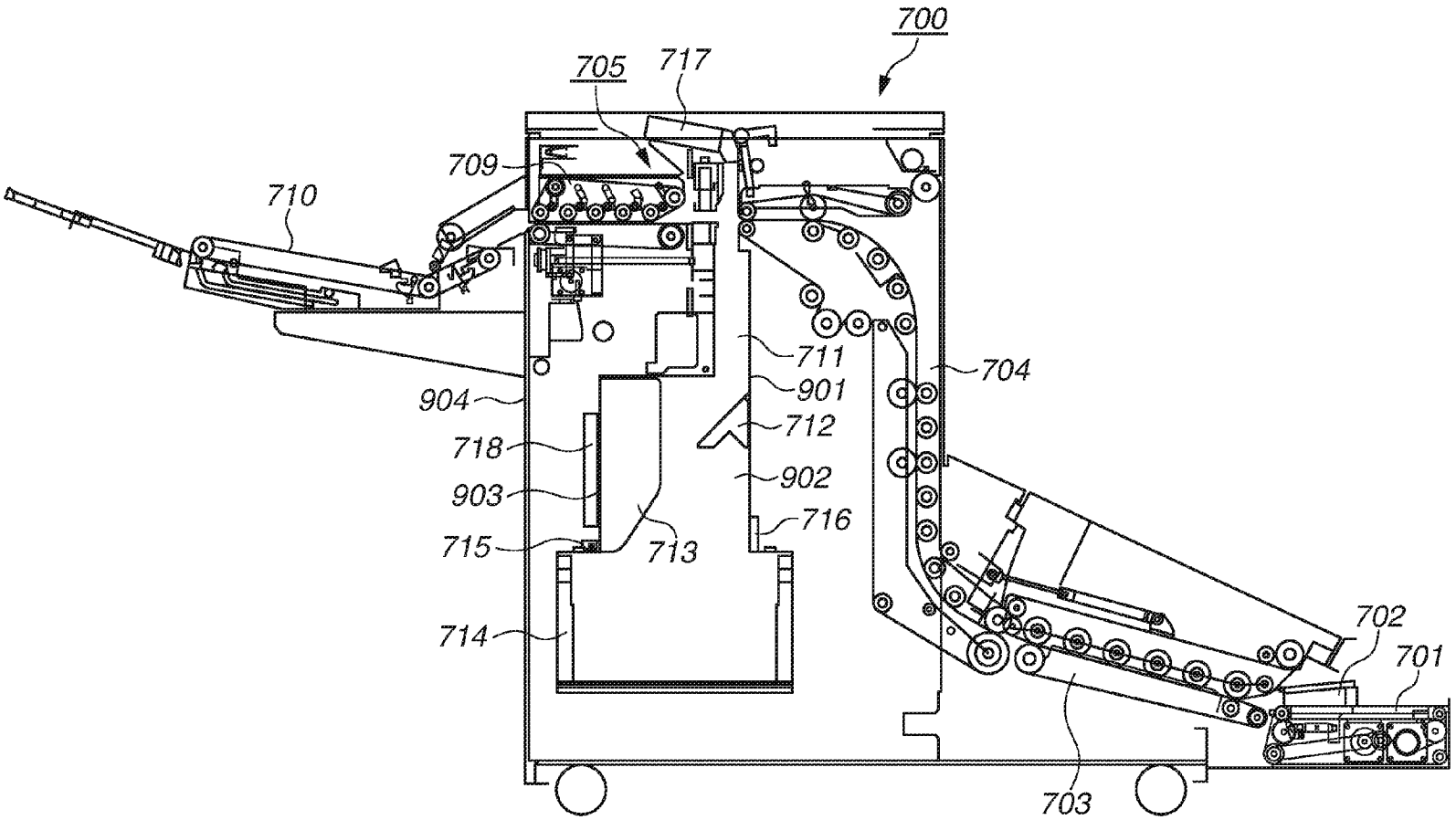
FIG. 4 is a cross-sectional diagram of a sheet cutting apparatus.

FIG. 4 is a cross-sectional diagram of the cutting apparatus 700 serving as a sheet cutting apparatus. Herein, although description will be given of a configuration in which the finisher 500 and the cutting apparatus 700 are provided as separate apparatuses, the finisher 500 and the cutting apparatus 700 may be configured integrally.

A receiving conveyance unit 701 is arranged on an upstream side of the cutting apparatus 700 in a conveyance direction. The receiving conveyance unit 701 includes a receiving conveyance belt that receives a sheet bundle discharged from the discharge roller 1016 of the finisher 500 on the upper surface thereof and rotates to convey the sheet bundle.

A side regulation plate 702 executes position correction and skew correction in the main scanning direction with respect to the sheet bundle received by the receiving conveyance unit 701. The sheet bundle subjected to the position correction and the skew correction by the side regulation plate 702 is conveyed to an inlet conveyance unit 703. The inlet conveyance unit 703 is configured as a pair of conveyance belts for nipping and conveying the sheet bundle to convey the sheet bundle obliquely upward.

The sheet bundle conveyed by the inlet conveyance unit 703 is conveyed to a longitudinal path conveyance unit 704 serving as a conveyance unit. The longitudinal path conveyance unit 704 includes a pair of conveyance unit belts for nipping and conveying the sheet bundle in a conveyance path. The sheet bundle is conveyed to a cutting unit 705 for cutting the sheet bundle by the longitudinal path conveyance unit 704. The sheet bundle conveyed from the finisher 500 by the receiving conveyance unit 701 and the longitudinal path conveyance unit 704 is conveyed to the cutting unit 705 arranged at a position higher than the receiving conveyance unit 701 through which the sheet bundle is introduced to the cutting apparatus 700. The cutting unit 705 may also be arranged at a position higher than the nip portion of the folding roller pair 1006.

A front edge side of the sheet bundle is cut by the below-described cutting unit 705 according to a preset cutting width. The front edge side of the sheet bundle refers to an end portion on the opposite side of a folded portion of the sheet bundle. The sheet bundle of which the end portion is cut off is discharged to a discharge tray portion 710 from a discharge conveyance unit 709, so as to be stacked on the discharge tray portion 710. The discharge conveyance unit 709 includes a pair of conveyance belts, so that the sheet bundle is conveyed by the pair of conveyance belts and discharged to the discharge tray portion 710.

Small pieces of sheets (hereinafter, simply referred to as "cut scraps" or "scraps") generated at a time of sheet-cutting pass through a scrap path 902 including an introduction path 711 extending downward from the cutting unit 705, to fall into a container 714, which is arranged on a lower side of the cutting unit 705. The container 714 as a container unit for containing the scraps is arranged to be freely inserted to and taken out from a front side portion of the cutting apparatus 700. The scraps falling from the cutting unit 705 through the scrap path 902 are accumulated in the container 714.

When the scraps are accumulated to some extent in the container 714, an operator takes out the container 714 from the cutting apparatus 700 and removes the accumulated scraps from the container 714.

The cutting apparatus 700 includes means for detecting whether the container 714 is full of scraps. As illustrated in FIG. 4, a detection sensor light-emitting unit 715 and a detection sensor light-receiving unit 716 are arranged at a position slightly higher than the container 714. When the container 714 has become full with scraps, light emitted from the detection sensor light-emitting unit 715 is interrupted by the accumulated scraps. When the cutting apparatus 700 can confirm a state where the light cannot be received by the detection sensor light-receiving unit 716 for a specific period of time, the cutting apparatus 700 determines that the container 714 is full of scraps, and prompts removal of the scraps in the container 714 and temporary suspension of the entire system of the image forming apparatus. The detection sensor 716 may be configured as a detection unit or a part of a detection unit that may include one or more other components such as the light-emitting unit 715, circuitry, a processor, etc.

Figure 2:
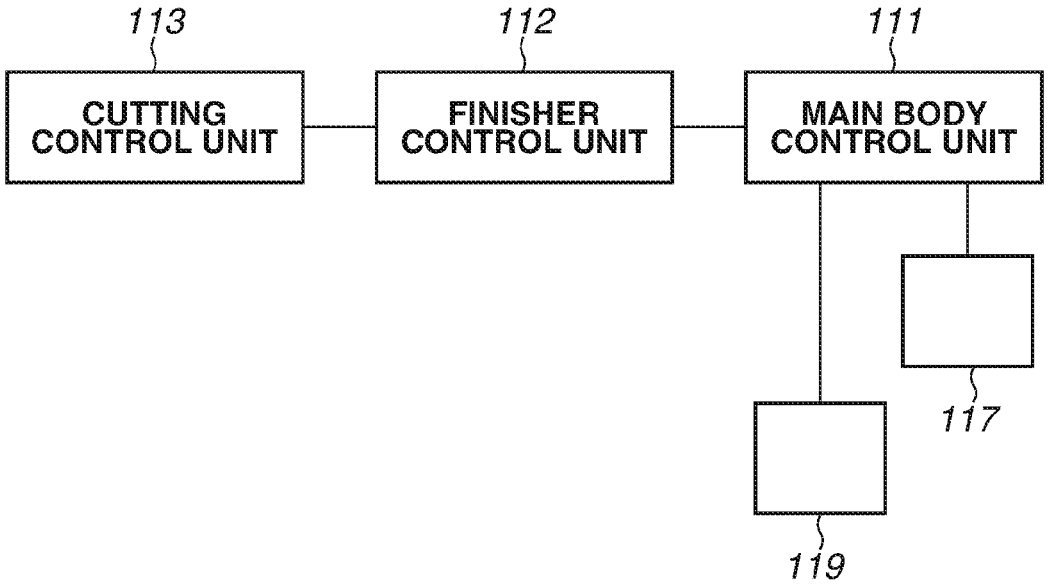
FIG. 2 is a block diagram of the image forming apparatus.

FIG. 2 is a diagram illustrating a control block of the image forming apparatus. A main body control unit 111 is provided on the printer main body 100. The main body control unit 111 controls an image formation control unit 117 that controls operations relating to image formation. The main body control unit 111 is configured to be communicable with an external device via an interface 119. A finisher control unit 112 for controlling the finisher 500 and a cutting control unit 113 for controlling the cutting apparatus 700 are connected to the main body control unit 111.

As illustrated in FIG. 1, the longitudinal path conveyance unit 704 serving as a conveyance unit conveys a sheet to the cutting unit 705 arranged at a position higher than the folding roller pair 1006 of the finisher 500. With this configuration, the container 714 can be arranged in a position separated from the cutting unit 705 in a height direction. Accordingly, the scraps accumulated in the container 714 can be prevented from interfering with the cutting unit 705 while the capacity of the container 714 can be increased. In other words, a sheet processing apparatus according to the present exemplary embodiment including the finisher 500 and the cutting apparatus 700 solves a problem that a capacity of the container 714 cannot be increased, arising in the conventional configuration having a cutting unit arranged at a lower position.

<Cutting Unit>

Figure 12:
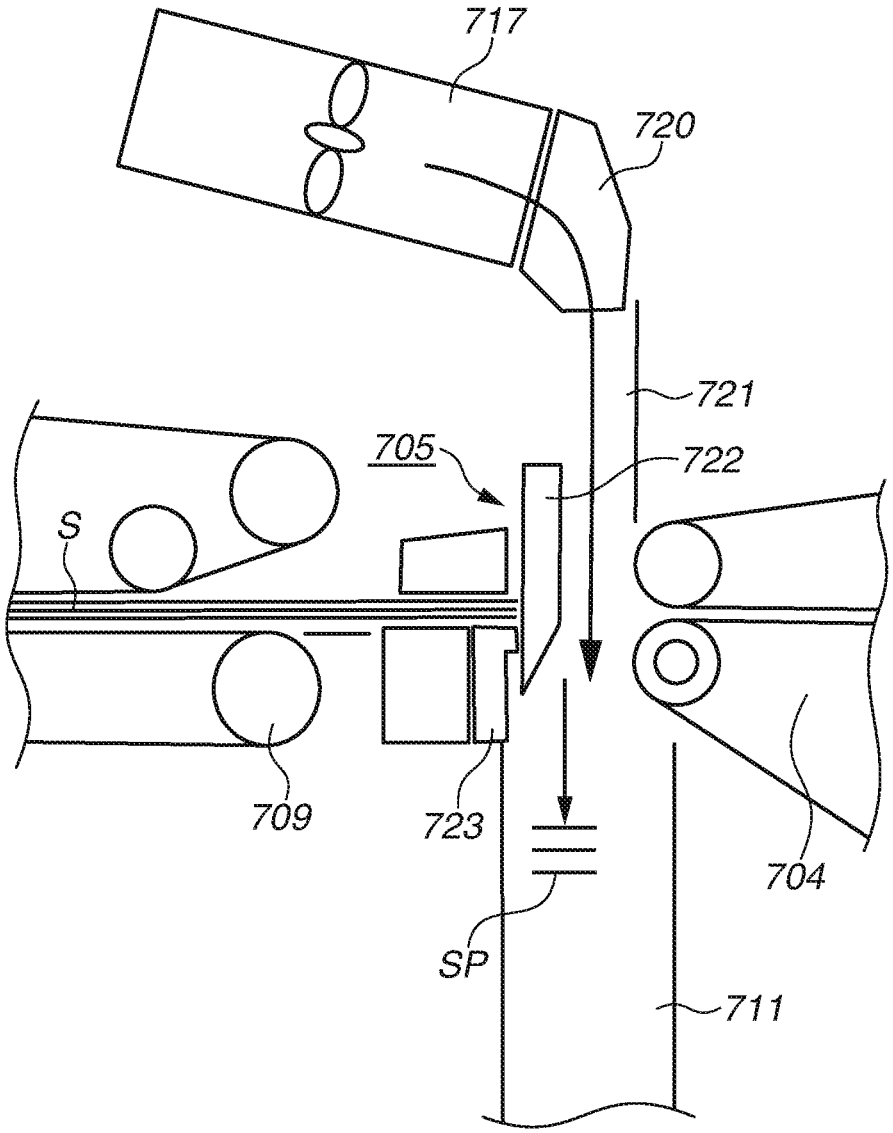
FIG. 12 is a diagram illustrating a configuration of a cutting unit and units arranged in a vicinity of the cutting unit.

A configuration of the cutting unit 705 will be specifically described with reference to FIG. 12.

The cutting unit 705 serving as a cutting means includes an upper blade 722 that moves up and down to cut a part of a sheet bundle S and a fixed lower blade 723 for cutting the sheet bundle S in cooperation with the upper blade 722. The upper blade (movable blade) 722 and the lower blade (fixed blade) 723 are arranged between the vertical path conveyance unit 704 and the discharge conveyance unit 709.

A blower device 717 is arranged on an upper side of the cutting unit 705 and the conveyance path. The blower device 717 serving as a blowing unit includes one or more fans rotated by a motor to generate a stream of air (wind). Ducts 720 and 721 for sending the air generated by the blower device 717 to a cutting position for cutting the sheet bundle with a pair of blades (upper and lower blades 722 and 723) are provided on the cutting apparatus 700. In other words, the ducts 720 and 721 are arranged so as to make downstream end portions (blowing ports) of the ducts 720 and 721 in the air flow direction face the upper and the lower blades 722 and 723. The air blowing port of the duct 721 extends in a sheet width direction intersecting with a sheet conveyance direction.

When the upper blade 722 moves downward to cut the end portion of the sheets in cooperation with the lower blade 723, the blower device 717 sends air to a position (cutting position) where the sheets are actually cut by the upper and the lower blades 722 and 723. Because of the air sent from the blower device 717, scraps are prevented from sticking to the upper blade 722 and/or the lower blade 723. The scraps fall into the introduction path 711 due to an effect of the sent air and their own weight.

<Scrap Path>

Description will be given of a configuration of the scrap path 902 that allows the scraps generated when the sheets are cut by the cutting unit 705 to pass through and travel toward the container 714. As illustrated in FIG. 4, the scrap path 902 is formed of a vertically-extending first plate 901 and a second plate 903 as a vertically-extending plate-like member facing the first plate 901. In addition, the second plate 903 constitutes a side surface of the scrap path 902 in the present exemplary embodiment.

Figure 7A:
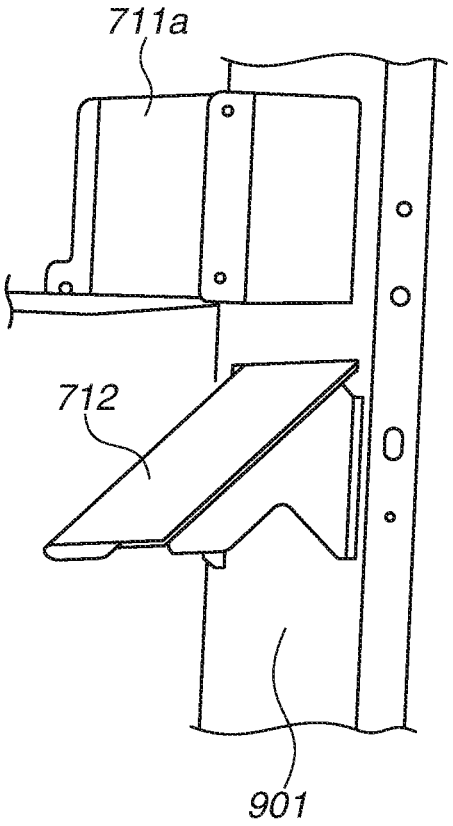
FIGS. 7A and 7B are perspective diagrams illustrating a configuration of a first scattering member.

As illustrated in the perspective diagram in FIG. 7A, an introduction guide 711*a* attached to the first plate 901 is arranged on the upstream side in the scrap path 902 in the travelling directions of the scraps. The introduction guide 711*a* is a member having a U-shaped cross-section when viewed in a horizontal direction. The introduction guide 711*a* and the first plate 901 form the introduction path 711 for allowing the falling scraps to pass through.

A first scattering member 712 for scattering the scraps generated when the sheets are cut by the cutting apparatus 700 is arranged on the lower side of the introduction guide 711*a*.

As illustrated in FIG. 4, the first scattering member 712 is arranged just beneath the introduction path 711 on the lower side in the vertical direction of the cutting position of the cutting unit 705. As illustrated in FIG. 7A, the first scattering member 712 is supported by the first plate 901, so as to project from the first plate 901. The first scattering member 712 is configured to include an inclined face (flat face) as an inclined portion on an upper portion thereof. The inclined face is gradually away from the first plate 901 as it inclines downward.

Figure 7B:
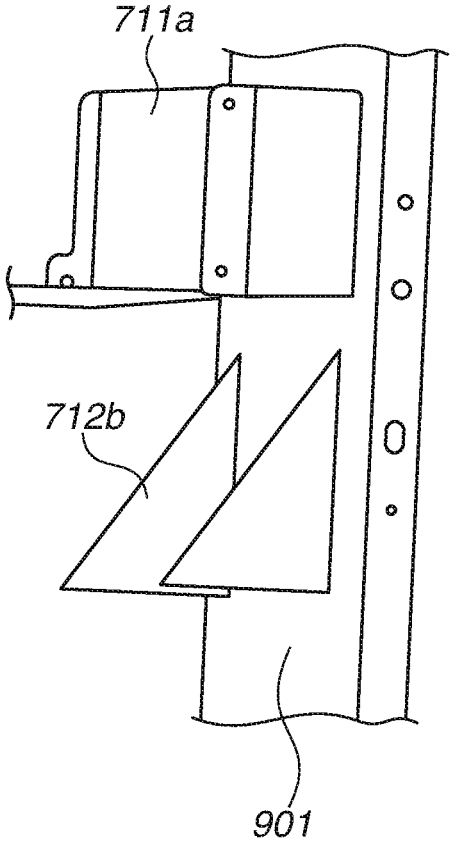

In the present exemplary embodiment, a member having an inclined face on the upper side thereof has been described as an example of the first scattering member 712. However, as illustrated in FIG. 7B, a plurality of rib-like scattering members 712*b* projecting from the first plate 901 may be provided. These rib-like scattering members 712*b* also have inclined portions on the upper sides thereof.

Figure 10:
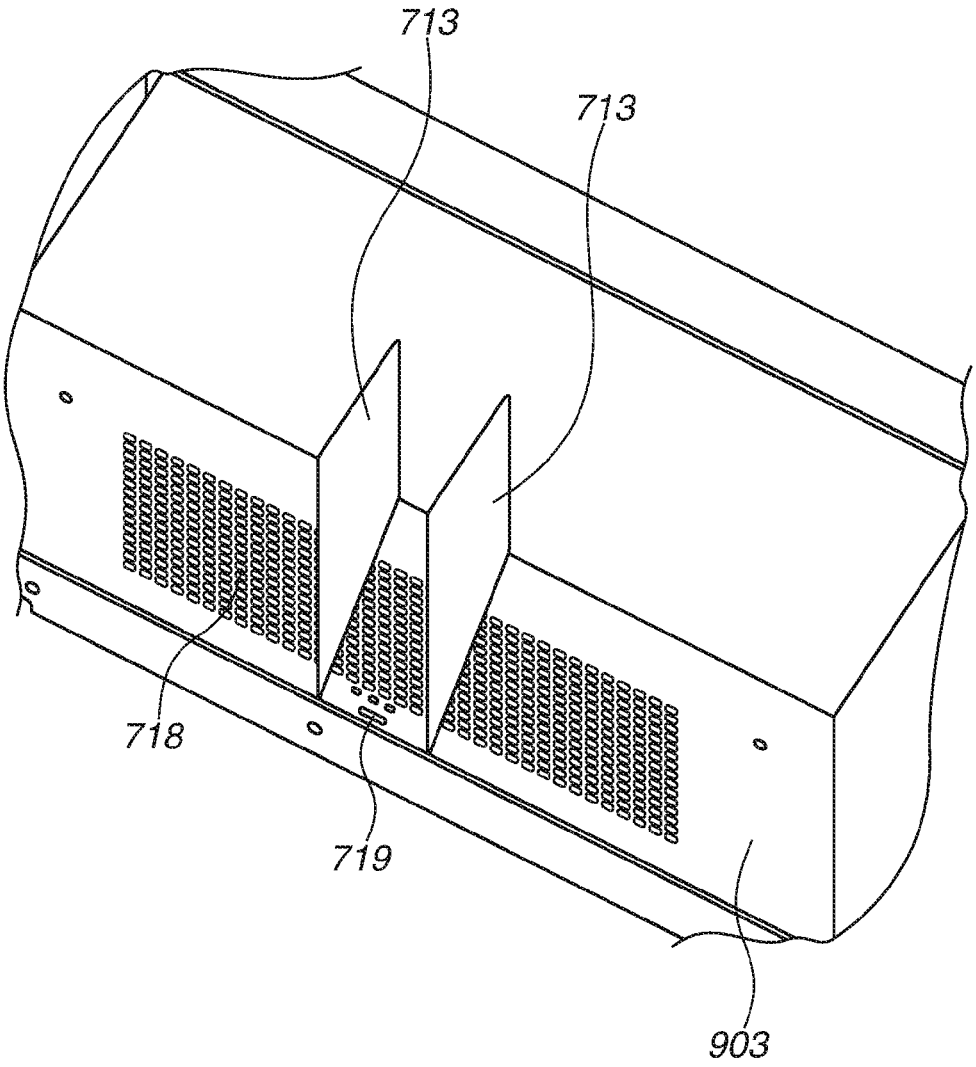
FIG. 10 is a diagram illustrating a configuration of a second scattering member and openings.

As illustrated in the perspective diagram in FIG. 10, a second scattering member 713 projecting from the second plate 903, which serves as a member for regulating the scrap path 902, is arranged at a position displaced from the first scattering member 712 in the horizontal direction. The second scattering member 713 is arranged in such a manner that at least one portion thereof is positioned on the lower side of a portion the lowest in the inclined face of the first scattering member 712. As illustrated in FIG. 10, the second scattering member 713 is configured of plate-like members and arranged on both sides of a hole 719 for allowing the light emitted from the detection sensor light-emitting unit 715 to transmit therethrough. In addition, a number of rib members constituting the second scattering member 713 is not limited specifically.

A plurality of openings 718 for allowing the air to pass through is formed on the second plate 903 to which the second scattering member 713 is attached. Each of the openings 718 has a size capable of preventing the scraps from travelling therethrough to the outside of the scrap path 902. The openings 718 function as a filter that allows the air to pass through and prevent the scraps from travelling therethrough to the outside of the scrap path 902. The openings 718 described as one example of the present exemplary embodiment are a great number of holes made on the metallic second plate 903. A material of the second plate 903 is not limited specifically. A fabric for enabling air to pass therethrough and preventing the scraps from passing therethrough may be provided on the openings 718 formed on the second plate 903 to cause the openings 718 function as a filter.

Because of the following reason, the second scattering member 713 is arranged on both sides of the hole 719 through which the light emitted from the detection sensor light-emitting unit 715 transmits. Specifically, with the above-described configuration, scraps can be prevented from sticking to the second plate 903 in a vicinity of the openings 718 because of the air flowing toward the openings 718, so that the light emitted by the detection sensor light-emitting unit 715 will not be interrupted thereby.

Figure 9:
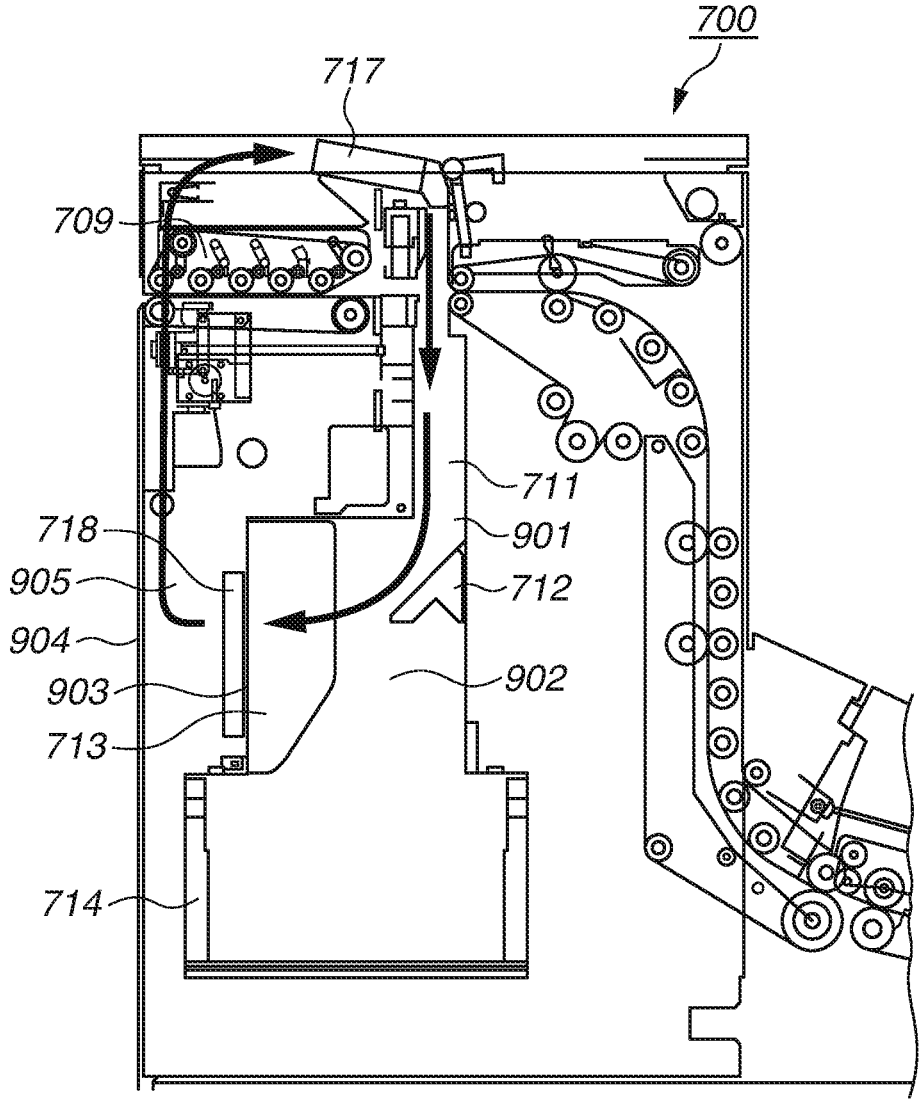
FIG. 9 is a diagram illustrating airflow of the sheet cutting apparatus.

In addition, as illustrated in FIG. 9, an air flow path (duct) 905 extending upward is configured of the second plate 903 and one side portion 904 of a housing of the cutting apparatus 700. In the cutting apparatus 700, the air flow path 905 enables the air flowing upward to flow into the blower device 717 via the discharge conveyance unit 709. In other words, the air sent from the blower device 717 flows into the air flow path 905 via the openings 718 of the second plate 903 from the scrap path 902, and returns to the blower device 717 through the air flow path 905. As described above, the air sent from the blower device 717 circulates within the cutting apparatus 700.

<Action of Scattering Member>

The first scattering member 712 and the second scattering member 713 is for improving accumulated state of the scraps SP within the container 714. Hereinafter, functions of the first scattering member 712 and the second scattering member 713 will be described.

Figure 5:
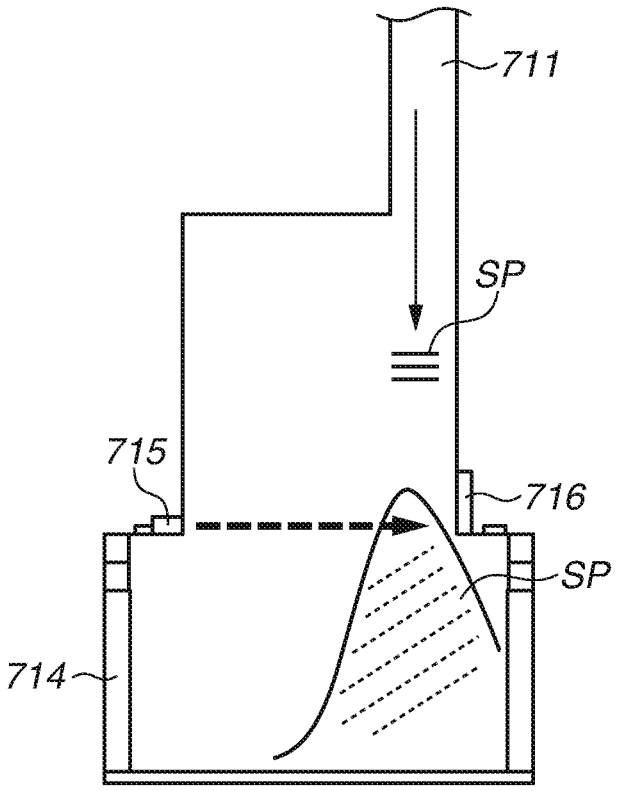
FIG. 5 is a diagram illustrating an accumulation state of scraps.
Figure 6A:
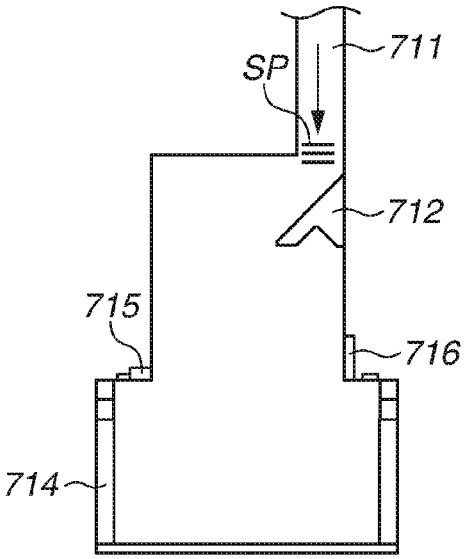
FIGS. 6A, 6B, 6C, and 6D are diagrams illustrating a variation example.
Figure 6B:
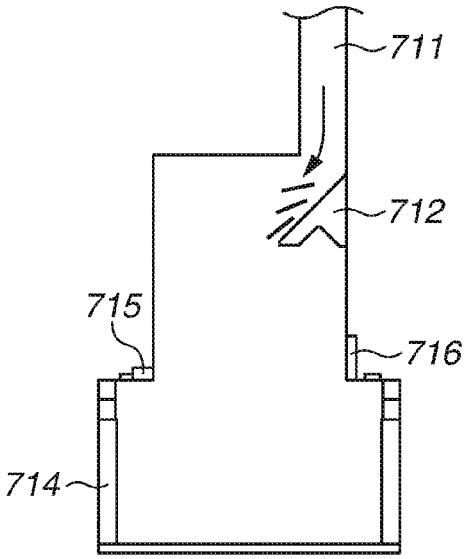
Figure 6C:
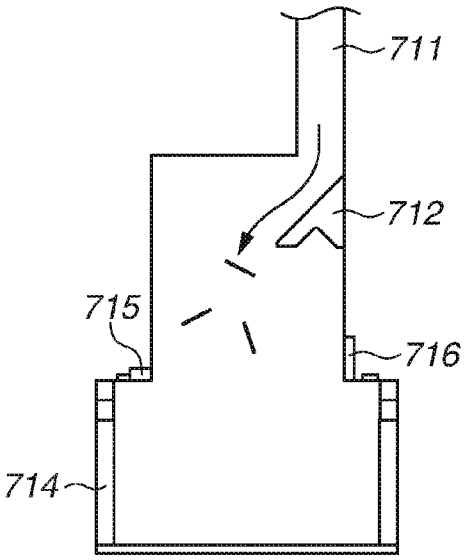
Figure 6D:
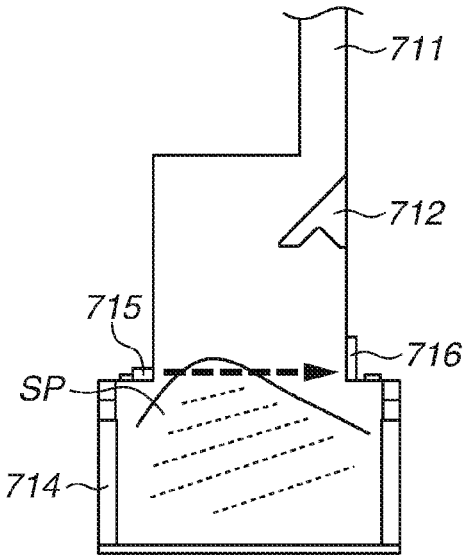

In a case where the scraps SP fall into the container 714 approximately linearly from the cutting unit 705 (see FIG. 5), the scraps SP are accumulated in the container 714 as described below. Specifically, in a case of thick sheets or scraps having wide width, the scraps are relatively scattered by the impact of landing in the container 714, so that the scraps are accumulated across the container 714. On the other hand, in a case of very thin sheets or scraps having narrow width, the scraps remain at landing positions, so that the scraps are unevenly accumulated in the container 714. Because the scraps are accumulated unevenly, the capacity of the container 714 cannot be utilized sufficiently, and there arises a problem that the container 714 is detected as a full state even if an amount of the scraps much less than the containable amount of the container 714 are accumulated (see FIG. 5).

Further, the scraps SP with very thin thickness are likely to be electrically charged with static electricity especially under the environment having low humidity. Therefore, the scraps SP are likely to stick to the side face in the intermediate position before landing in the container 714. In a worst case, if the scraps SP stick to a light-receiving position of the detection sensor light-receiving unit 716 on the side face of the scrap path 902 as a scrap passage to the container 714, there arises a problem that the container 714 is determined as a full state even if only a small amount of scraps SP are discharged. As a similar case, under the high humidity environment, if water droplets caused by dew condensation are attached to the scraps SP with very thin thickness, the scraps SP may stick to the side face in the intermediate position before landing in the container 714.

The first scattering member 712 is arranged on the scrap path 902 in order to solve the above-described problem.

Herein, each of the scraps SP generated by the cutting apparatus 700 for cutting the end portion of the sheet bundle has a rectangular strip shape. Because a plurality of sheets is collectively cut by a single cutting operation, a plurality of rectangular strip-shaped scraps SP falls from the cutting unit 705 in an overlapped bundle state (see FIG. 11A). The falling scraps SP hit against the inclined face of the first scattering member 712, so that the travelling directions of the scraps SP are changed by the first scattering member 712 serving as a changing unit, and the bundle of scraps SP is separated into pieces (see FIG. 11B). Herein, separating the bundle of scraps SP into pieces is referred to as scattering of the scraps SP. Because of the influence of repulsion force at the time of impact against the first scattering member 712 and own air resistance with respect to the travelling air, each of the scraps SP makes a rotation movement or a sliding movement so as to be scattered in the air. The scraps SP scattered by the first scattering member 712 travel toward the second scattering member 713 caused by the upper inclined face of the first scattering member 712. Then, the scraps SP are brought into contact with the leading end portion of the second scattering member 713 and further scattered by the second scattering member 713 (see FIG. 11C).

The scattered scraps SP are accumulated in the container 714 in a scattered state. In the present exemplary embodiment, because the travelling directions of the scraps SP are changed, the scraps SP are easily prevented from sticking to the light-receiving position of the detection sensor light-receiving unit 716.

As described above, because the first scattering member 712 is provided with the inclined portion, the scraps can be scattered favorably during falling. With respect to a cutting apparatus using the sheets that generate scraps charged with static electricity, or a cutting apparatus used under the environment where dew condensation is likely to occur, the scraps can be easily prevented from sticking to the scattering member itself by using the scattering member 712*b* configured of ribs as illustrated in FIG. 7B.

As described above, with respect to the cutting apparatus that processes relatively a few types of the cutting-target sheets, even if the second scattering member 713 is not provided thereon, a sufficient effect can be obtained only with the first scattering member 712 as illustrated in FIG. 6, and thus the cutting apparatus may not have to include the second scattering member 713.

Figure 8:
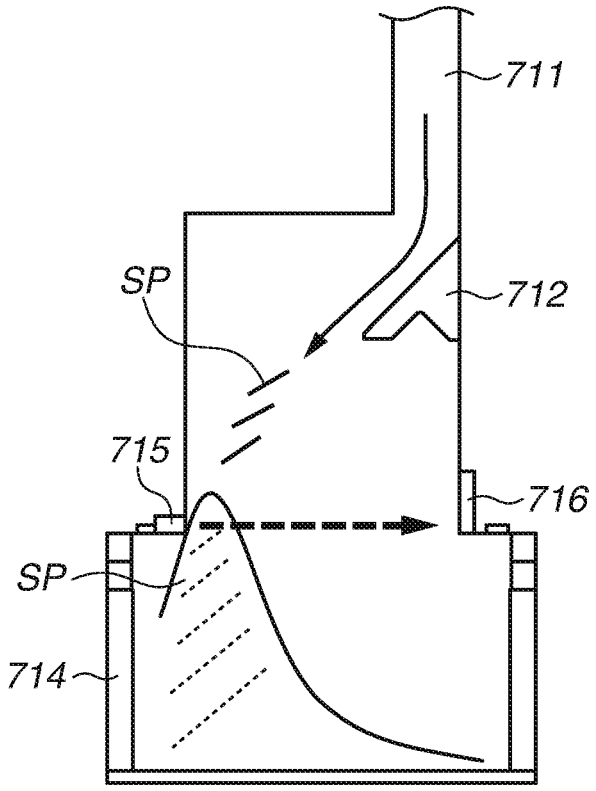
FIG. 8 is a diagram illustrating an accumulation state of scraps.

However, as illustrated in FIG. 8, in a case where the sheet itself is thick (i.e., weight of a single scrap is heavy), such as a sheet having a grammage greater than 200 g/m$^2$, there is a case where the scraps cannot be scattered sufficiently only with the first scattering member 712. More specifically, as illustrated in FIG. 8, the scraps are not scattered sufficiently only with the first scattering member 712, so that the scraps fall along a certain parabolic line. As a result, the scraps are unevenly accumulated in a part of the container 714, and the container 714 is detected as a full state although the capacity has not been utilized sufficiently.

On the contrary, in a case where the sheet itself is thin (i.e., weight of a single scrap is low), such as a sheet having a grammage less than 60 g/m$^2$, there may be a case where the scraps stick to the wall of the scrap path 902. More specifically, in a case where the scraps are electrically charged with very weak static electricity or a certain amount of moisture caused by dew condensation is adhered thereto, the scraps may stick to the second plate 903 on a side of the detection sensor light-emitting unit 715 to interrupt the sensor light, so that the container 714 is detected as a full state only with a small amount of scraps.

In consideration of the above-described problem, in the present exemplary embodiment, the second scattering member 713 is also provided to face the first scattering member 712.

<Airflow>

Next, airflow within the cutting apparatus 700 will be described with reference to FIG. 9.

As described above, the blower device 717 substantially generates airflow flowing downward at an inlet of the introduction path 711. In other words, the air sent from the blower device 717 flows from the top to the bottom of the introduction path 711 of the scrap path 902 to help the falling of scraps. After that, an orientation of the flowing air is deflected toward the openings 718 of the second plate 903, so that the air passes through the openings 718 of the second plate 903.

In other words, by arranging the openings 718 on the second plate 903 that constitutes the scrap path 902, the air sent from the blower device 717 flows into the openings 718. As described above, by discharging the air from the side face (second plate 903) of the scrap path 902, the air is prevented from blowing (flowing) into the container 714 from the blower device 717 as much as possible. By preventing the air from blowing into the container 714, the scraps already accumulated in the container 714 will not be blown up by the air, and the air will not accelerate uneven accumulation of scraps in a part of the container 714. Further, by passing the air through the openings 718, the air can be discharged from the scrap path 902 while the scraps are prevented from leaking out of the scrap path 902.

As illustrated in FIG. 9, the air flowing into the openings 718 of the second plate 903 flows upward along the air flow path 905 between the second plate 903 and the one side portion 904 of the housing of the cutting apparatus 700. The air flowing upward through the air flow path 905 flows into the blower device 717 via the discharge conveyance portion 709. In other words, the air sent from the blower device 717 flows into the air flow path 905 via the openings 718 of the second plate 903 from the scrap path 902, and returns to the blower device 717 from the air flow path 905. As described above, the air sent from the blower device 717 circulates within the cutting apparatus 700. The second plate 903 and the left side portion (external face) of the housing of the cutting apparatus 700 illustrated in FIG. 9 form a duct for guiding the air flowing upward to the blower device 717, i.e., a flow path which allows the air passing through the openings 718 as a discharge port of the scrap path 902 to flow into the blower device 717.

In the present exemplary embodiment, air flowing downward in the vertical direction through the introduction path 711 is deflected to flow toward the openings 718 of the second plate 903 because of the actions of both the blower device 717 and the first scattering member 712. In other words, the deflection of air is realized by guiding the air to the inclined face of the first scattering member 712 which gradually approaches the second plate 903 as it inclines downward. The deflection of air is also realized by the airflow generated by the blower device 717 for circulating the air within the cutting apparatus 700. Although description has been given of the exemplary embodiment in which deflection of air is realized by both of the actions of the blower device 717 and the first scattering member 712, the air may be deflected by using any one of the effects.

Further, description has been given of the exemplary embodiment in which the air passing through the openings 718 of the second plate 903 is sent upward along the air flow path 905. However, an opening may be provided on one side portion of the housing of the cutting apparatus 700, so that air can be discharged to the outside of the cutting apparatus 700 by a fan 921 as indicated by an arrow in FIG. 13. In this case, the air flowing downward in the vertical direction in the introduction path 711 is deflected by the fan 921 so as to flow toward the openings 718 of the second plate 903.

Figure 13:
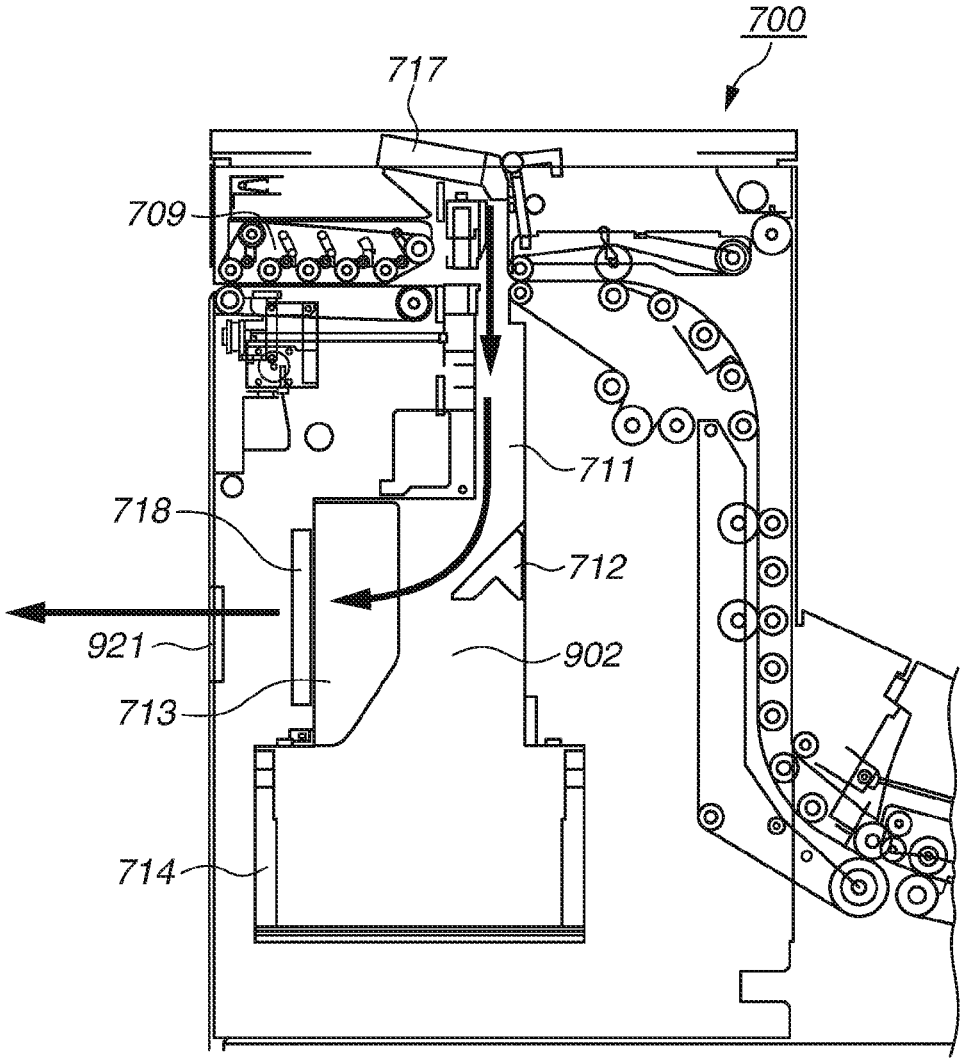
FIG. 13 is a cross-sectional diagram illustrating a variation example.

In addition, in a configuration for circulating the air in the cutting apparatus 700, operating noise hardly leaks out of the cutting apparatus 700 in comparison with the configuration for discharging the air to the outside of the cutting apparatus 700 illustrated in FIG. 13. Therefore, in comparison with the configuration illustrated in FIG. 13, the configuration for circulating the air in the cutting apparatus 700 is advantageous in terms of noise reduction. Further, in the configuration for circulating the air in the cutting apparatus 700, another optional apparatus such as a cutting apparatus for cutting a top and a bottom of a sheet bundle may be disposed on the left side of the cutting apparatus 700.

A relationship between the falling scraps and a flow of air will be described with reference to FIGS. 11A, 11B, 11C, and 11D.

Figure 11A:
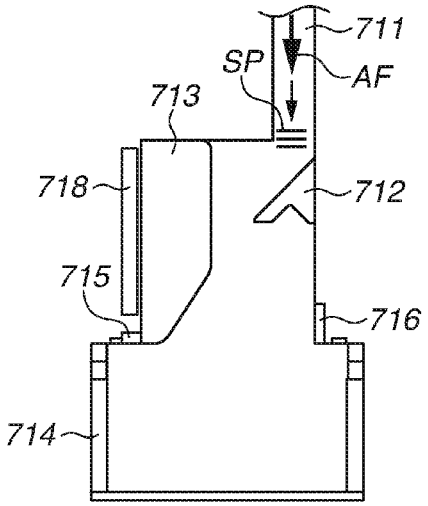
FIGS. 11A, 11B, 11C, and 11D are diagrams illustrating a falling state of scraps.
Figure 11B:
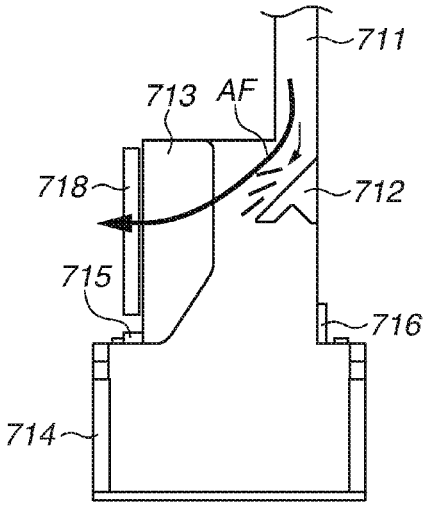
Figure 11C:
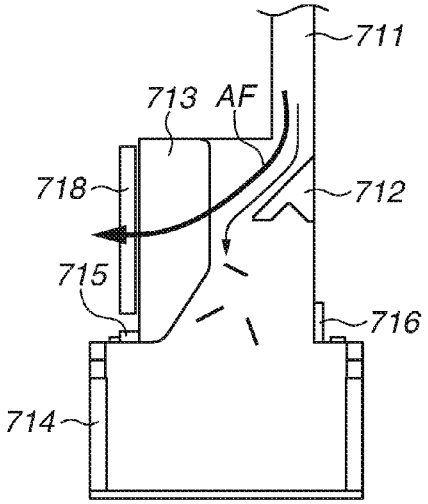
Figure 11D:
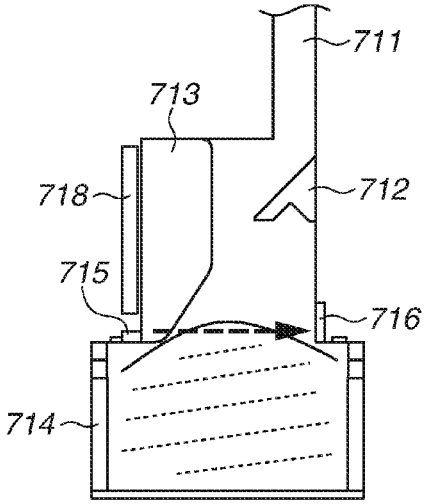

The scraps SP falling from the cutting unit 705 and passing through the introduction path 711 together with the air from the blower device 717 are scattered by hitting against the inclined face of the first scattering member 712 (see FIG. 11A). At that time, the scraps SP are scattered by the first scattering member 712 assisted by the influence of the air deflected toward the second plate 903 (see FIG. 11B).

After the travelling directions of the scraps SP are changed by the first scattering member 712, most of the scraps SP hit against the second scattering member 713 although there are some scraps SP that directly fall into the container 714. Simultaneously, the scraps SP depart from the airflow, and are scattered while making a rotation movement or a sliding movement, and eventually fall into the container 714 (see FIG. 11C).

The plate-like second scattering member 713 is projected from the second plate 903 in order to prevent the scraps SP from sticking to the second plate 903 because of the air flowing toward the openings 718 of the second plate 903.

As described above, in the present exemplary embodiment, the scraps SP are evenly accumulated across the whole part of the container 714 without being significantly influenced by the conditions such as a sheet type and a cutting width, so that the capacity of the container 714 can be utilized sufficiently.

Further, it is preferable that the air sent by the blower device 717 be temporarily stopped at a timing at which the scraps SP hit against the second scattering member 713 because the scraps SP can be scattered in the wider range. However, in order to easily execute the operation control of the blower device 717, the air may be sent by the blower device 717 constantly.

In any of the above described exemplary embodiments, because the air is eliminated via the openings 718 from the scrap path 902 which the scraps travelling to the container 714 pass through, an amount of air flowing into the container 714 is reduced. Accordingly, worsening of the accumulation state of the scraps caused by the air can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-109273, filed May 31, 2016, which is hereby incorporated by reference herein in its entirety.

What is claimed is:

1. A sheet cutting apparatus for cutting sheets on which images are formed, comprising:
- a cutting unit configured to cut the sheets supported on a supporting surface;
- a blowing unit disposed above the supporting surface and configured to blow air toward the cutting unit;
- a path member disposed below the supporting surface and configured to define a scrap path through which scraps generated when the cutting unit cuts the sheets pass; and
- a container unit configured to contain scraps which has passed through the scrap path,
- wherein the path member comprises a first portion disposed below the cutting unit and a second portion disposed below the first portion, an opening for allowing the air sent by the blowing unit to pass through is provided on the second portion of the path member, and
- wherein the container unit is disposed below the second portion of the path member.

2. The sheet cutting apparatus according to claim 1 further comprising a changing unit provided in the scrap path, configured to change travelling directions of the scraps.

3. The sheet cutting apparatus according to claim 2, wherein the changing unit includes an inclined portion inclined with respect to a horizontal direction, which the scraps travelling to the container unit from the cutting unit contacts.

4. The sheet cutting apparatus according to claim 2,
- wherein the path member provided with the opening extends vertically,
- wherein the changing unit includes a first member having an inclined portion gradually approaching the path member as inclining downward and a second member projecting toward the first member from the path member, which the scraps orientations of which are changed by the inclined portion of the first member contact.

5. The sheet cutting apparatus according to claim 1,
- wherein the blowing unit is provided so as to send air to the cutting unit from above,
- wherein the container unit is provided on a lower side of the cutting unit, and
- wherein the container unit contains the scraps falling from the cutting unit via the scrap path extending in a vertical direction.

6. The sheet cutting apparatus according to claim 1, wherein the path member provided with the opening is a member extending vertically.

7. The sheet cutting apparatus according to claim 1, wherein the path member provided with the opening functions as a filter that prevents the scraps from travelling to an outside of the scrap path and allows the air to pass through.

8. The sheet cutting apparatus according to claim 1 further comprising an air flow path configured to allow the air having passed through the opening and flowing toward the blowing unit to pass through,
- wherein the air sent by the blowing unit passes through the scrap path, the opening, and the air flow path to return to the blowing unit.

9. The sheet cutting apparatus according to claim 1, wherein the air having passed through the opening is discharged to the outside of the sheet cutting apparatus.

10. The sheet cutting apparatus according to claim 1 further comprising a detection unit configured to detect a state where the container unit becomes full with scraps.

11. The sheet cutting apparatus according to claim 1, further comprising a rib provided on the path member, wherein the rib projects into the scrap path and is arranged at a position corresponding to the opening.

12. The sheet cutting apparatus according to claim 11, wherein the rib extends in vertical direction and crosses a horizontal plane which passes the opening.

13. The sheet cutting apparatus according to claim 11, further comprising a second rib provided on the path member, the opening is arranged between the rib and the second rib.

14. The sheet cutting apparatus according to claim 1, wherein the path member extends in vertical direction.

15. The sheet cutting apparatus according to claim 1, wherein a plural of openings for allowing the air sent by the blowing unit to pass through are disposed on the second portion of the path member.

16. An image forming apparatus, comprising:

an image forming unit configured to form an image on a sheet; and the sheet cutting apparatus according to claim 1.

17. The image forming apparatus according to claim 16 further comprising:

a folding roller pair configured to fold a sheet on which an image is formed by the image forming unit; and a conveyance unit configured to convey the sheet folded by the folding roller pair to the cutting unit, wherein the container unit is arranged on a lower side of the cutting unit.

18. A sheet cutting apparatus for cutting a sheet on which an image is formed, comprising:

a blade configured to cut a sheet;

a blowing portion arranged on an upper side of a conveyance path which a sheet to be cut by the blade passes through and configured to blow air toward the blade;

a container unit arranged below the blade and configured to contain scraps generated when the sheet is cut by the blade; and a path member extending a vertical direction and disposed between the cutting unit and the container in the vertical direction, and configured to define a scrap path through which scraps generated when the cutting unit cuts the sheets pass;

an opening provided on the path member and configured to allow the air blown out from the blowing portion to pass through.

19. The sheet cutting apparatus according to claim 18, further comprising a rib provided on the path member, wherein the rib projects into the scrap path and is arranged at a position corresponding to the opening.

* * * * *